US005462248A

United States Patent [19]

Bauer

[11] Patent Number: 5,462,248

[45] Date of Patent: Oct. 31, 1995

[54] LONGITUDINALLY ADJUSTABLE COLUMN FOR CHAIRS, TABLES OR THE LIKE

[75] Inventor: Jürgen Bauer, Altdorf, Germany

[73] Assignee: Suspa Compart Aktiengesellschaft, Altdorf, Germany

[21] Appl. No.: 277,272

[22] Filed: Jul. 21, 1994

[30] Foreign Application Priority Data

Sep. 2, 1993 [DE] Germany ..... 43 29 611.4

[51] Int. Cl.[6] ..... A47C 3/30; A47B 9/10; F16F 9/02

[52] U.S. Cl. ..... 248/161; 248/159; 248/911; 297/344.18; 267/64.12

[58] Field of Search ..... 248/161, 159, 248/911, 407, 411, 414, 558, 188.5; 297/344.12, 344.18, 344.19, 344.21; 267/64.12, 120, 131; 188/300, 322.19

[56] References Cited

U.S. PATENT DOCUMENTS

| | | | |
|---|---|---|---|
| 2,722,970 | 11/1955 | Stechmann | 248/188.2 |
| 3,711,054 | 1/1973 | Bauer | 248/562 |
| 4,580,749 | 4/1986 | Howard | 248/161 |
| 4,733,911 | 3/1988 | Fulcheri | 297/344.18 X |
| 4,811,670 | 3/1989 | Kolvites et al. | 108/107 |
| 4,828,212 | 5/1989 | Dicks | 297/344.12 X |
| 4,969,619 | 11/1990 | Bauer et al. | 248/161 |
| 5,011,104 | 4/1991 | Fang | 248/161 X |

FOREIGN PATENT DOCUMENTS

| | | | |
|---|---|---|---|
| 0133524 | 11/1987 | European Pat. Off. . | |
| 2035950 | 2/1972 | Germany | 248/407 |
| 2747777 | 10/1977 | Germany . | |
| 2921610 | 5/1979 | Germany . | |
| 3337598 | 5/1984 | Germany . | |
| 100436 | 7/1923 | Switzerland . | |
| 2021940 | 5/1979 | United Kingdom . | |

*Primary Examiner*—Josie A. Ballato
*Attorney, Agent, or Firm*—Browdy and Neimark

[57] ABSTRACT

A longitudinally adjustable column for chairs, tables or the like comprises an upright tube and a length-adjusting element arranged in the upright tube. For fastening to a pedestal a sleeve-like cone section is provided, which is provided on its internal side with at least one recess, with which engages a projection. Over the length of the upright tube several of such projections are provided at a distance from each other, so that the cone section formed by half shells or being simply slotted can be fixed in different height positions on the upright tube in the direction of the axis.

9 Claims, 3 Drawing Sheets

FIG. 1
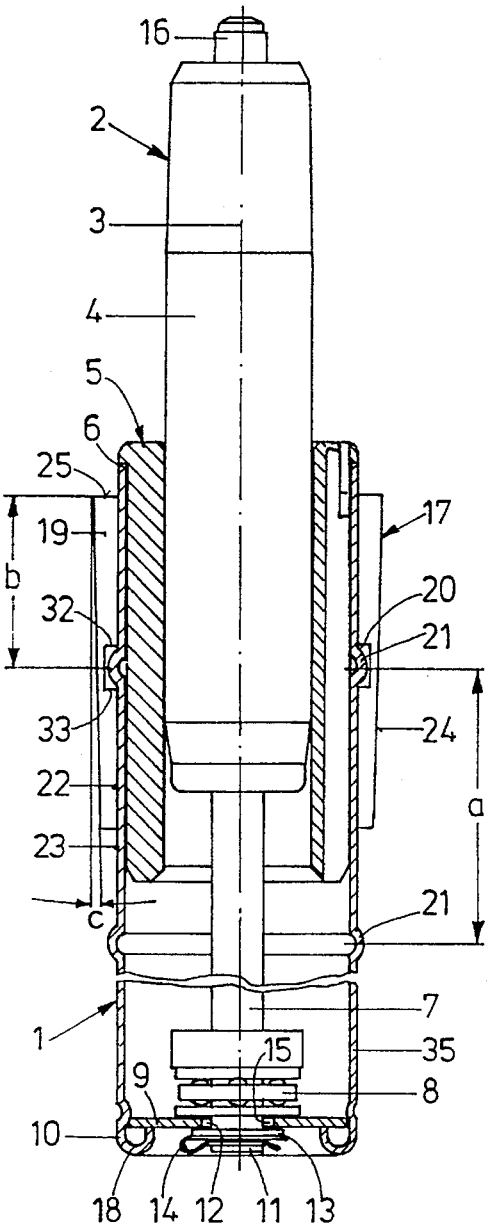
FIG. 3
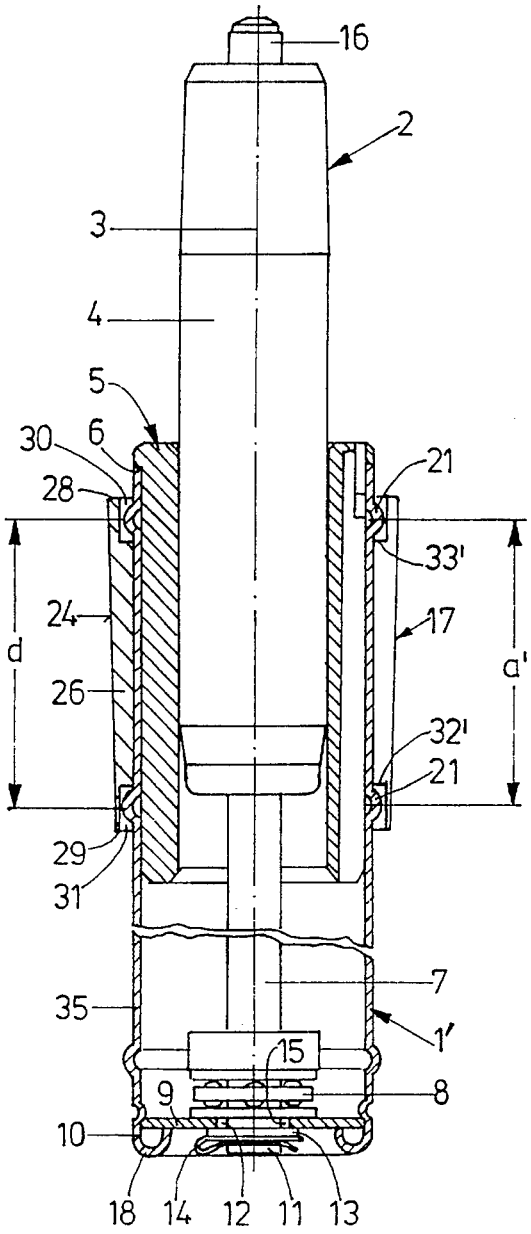
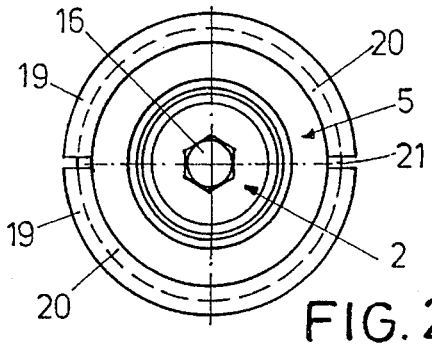
FIG. 2
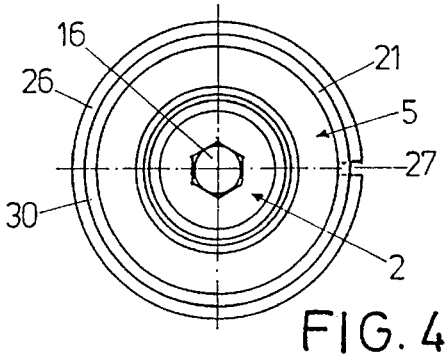
FIG. 4

LONGITUDINALLY ADJUSTABLE COLUMN FOR CHAIRS, TABLES OR THE LIKE

BACKGROUND OF THE INVENTION

1. Field of the Invention

The invention refers to a longitudinally adjustable column for chairs, tables or the like.

1. Background Art

From German Patent 27 47 777 C2 a bottom frame for a chair is known, which comprises a pedestal and a longitudinally adjustable column. The column—related to the central longitudinal axis of the column—is provided with projections protruding outwardly and being arranged at a distance from each other. Blind grooves are associated with these projections in a cylindrical bore of hub of the pedestal. In the pedestal furthermore a clamping wedge is provided, by means of which the upright tube of the column can be pressed against the wall of the bore of hub, so that the projections of the upright tube are pressed into the blind grooves. By these measures the chair column itself can be adjusted in its height in relation to the pedestal formed by a hub and chair feet. The change in height setting is extremely complicated. In addition, the pedestal itself must be formed by grooves and blind grooves especially for the engagement of the projections.

From U.S. Pat. No. 2,722,970 and from CH-Patent 100 436 further complicated measures for height adjustment of a chair column in relation to a pedestal are known.

SUMMARY OF THE INVENTION

It is the object of the invention to create a longitudinally adjustable column for chairs, tables or the like, which can be connected in simple manner with a pedestal.

This object is attained in accordance with the invention by an upright tube with a central longitudinal axis, by an external side and by at least two projections which are—related to the central longitudinal axis—arranged at a distance from each other, by one of a pneumatic or hydropneumatic length-adjusting element arranged concentrically with the central longitudinal axis in the upright tube, by a sleeve-like cone section with an external conical surface and with an internal side for abutment on the external side of the upright tube and by at least one recess engageable with one of said at least two projections. Based on the features according to the invention the pedestal can be embodied as is usual the case, i.e. it comprises a conical hub and foot struts extending outward from the hub. The conical hub is embodied in the same manner as is generally the case for longitudinally adjustable columns, in particular for chairs, but also for tables, which have the upright tube provided with a cone section formed at the upright tube itself. The cone section is not integrated into the upright tube, but in relation to the latter is a separate component in the shape of a sleeve, which is slotted or which consists of two half shells. The basic height adjustment of the longitudinally adjustable column in relation to the pedestal can be changed over approximately the full length of the upright tube of the chair column.

Further features, advantages and details of the invention will become apparent from the description of examples of embodiment of the invention taken in conjunction with the drawing.

BRIEF DESCRIPTION OF THE DRAWING

FIG. 1 shows a longitudinal view of a chair column in a partially cutaway representation, FIG. 2 shows a plan view of the column according to FIG. 1, FIG. 3 shows a longitudinal view of a second embodiment of a chair column in a partially cut-away representation, FIG. 4 shows a plan view of the chair colum according to FIG. 3.

DESCRIPTION OF THE PREFERRED EMBODIMENTS

Figure 5:
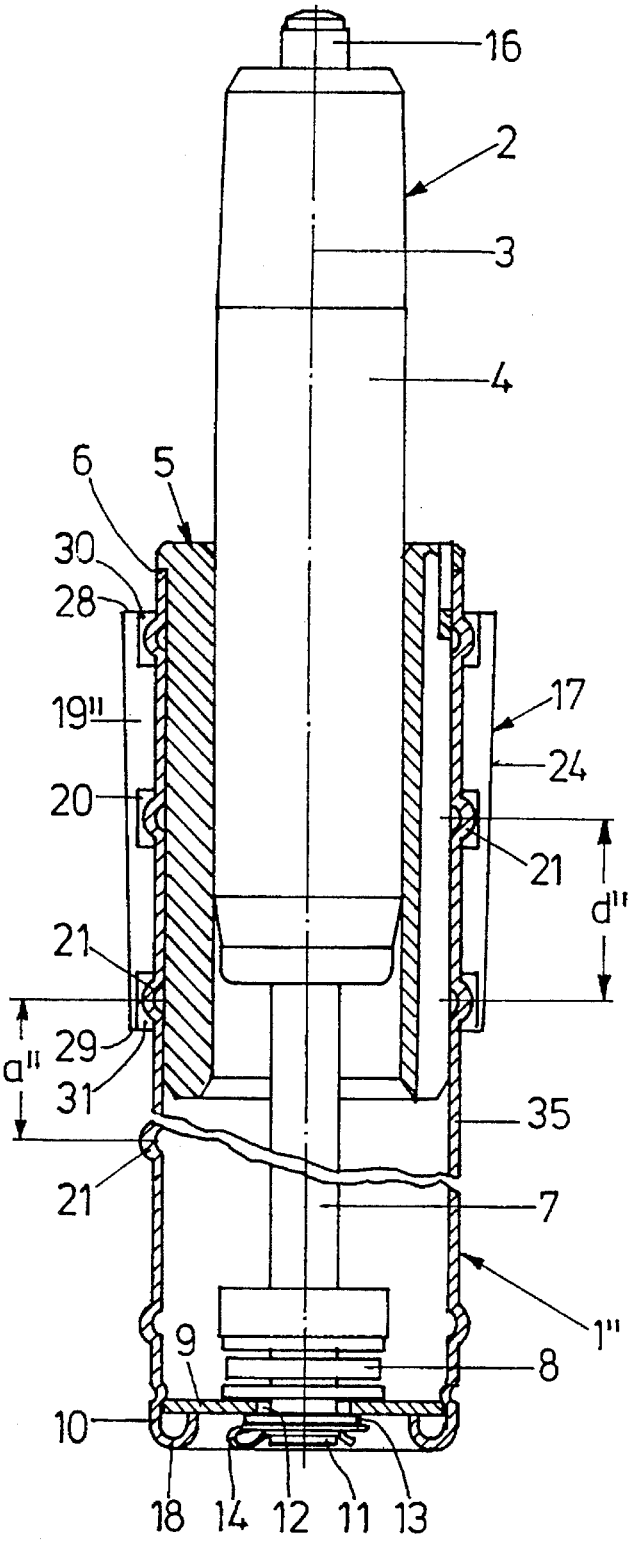
FIG. 5 shows a longitudinal view of a third embodiment of a chair column in a partially cut-away representation.

The chair column shown in the drawing comprises an upright tube 1, in which a logitudinally adjustable gas spring in the form of a pneumatic or hydropneumatic piston-cylinder adjusting element is disposed. The upright tube 1 and the gas spring 2 have a common central longitudinal axis 3.

An external housing 4 of the gas spring 2 is displaceably supported in the direction of the axis 3 in a guide bushing 5, which is disposed on one end 6—in the drawing, the upper end of the upright tube 1. This external housing 4 of the gas spring 2 may either be the housing of the spring itself, or a protected tube outwardly surrounding that housing.

Protruding from the housing 4 of the gas spring is a piston rod 7, which is supported in the direction of the axis 3 via an axial roller bearing 8 relative to a bottom plate 9 of the upright tube 1. The bottom plate 9 is located on the other end 10 of the upright tube 1 opposite the one end 6; in the drawing, the end 10 is shown at the bottom. A protrusion 11 of the piston rod 7 that penetrates the axial roller bearing 8 extends through an opening 12, embodied concentrically with the axis 3, of the bottom plate 9. A shim 13 and a spring securing ring 14 secure the protrusion 11 against being pulled out toward the underside of the bottom plate 9. The diameter of the opening 12 is larger than the diameter of the protrusion 11. With this kind of fastening, the gas spring 2 is rotatable relative to the upright tube 1. Because of the radial play 15 between the protrusion 11 and the opening 12, the gas spring is guided in the guide bushing 5 inclinably to a low degree or in other words without tilting relative to the upright tube 1. Finally, with its piston rod 7, it is fixed relative to the upright tube 1 in the direction of the axis 3, so that upon longitudinal adjustment of the gas spring 2 by actuation of an actuating pin 16, the housing 4 of the gas spring 2 is extended out of the upright tube 1 or retracted into it. The acuating pin 16 is located on the end of the housing 4 of the gas spring 2 opposite the piston rod 7. A chair seat or a table top is also secured there.

The upright tube 1 is provided with a cone section 17 tapering slightly conically toward the end 10, by means of which cone section 17 it is possible to fasten the upright tube 1 in a corresponding conical hub of a pedestal or the like.

The column as described thus far, used primarily as a chair column but also as a column for tables or the like, is generally known and available on the market; it is for instance described and shown in U.S. Pat. No. 3,711,054 or European Patent 0 133 524.

The bottom plate 9 in the form of an annular disk is supported on a rim 18, which is rolled inward in cup-like fashion, of the upright tube 1 in the vicinity of its end 10. This inwardly rolled rim has an approximately semicircular shape in cross-section; in other words, it has approximately the cross section of half of a circular ring. This embodiment is known from U.S. Pat. No. 4,969,619.

The embodiment of the upright tube 1 together with the cone section 17, which is described in detail in the following, is new.

The cone section 17 is embodied as an independent section not formed or shaped on the upright tube 1. It basically consists of a sleeve. With the embodiment according to FIGS. 1 and 2 this sleeve forming the cone section 17 consists of two identical half shells 19, i.e. the sleeve is divided lengthwise in a plane accommodating the central longitudinal axis 3. On approximately half of their length, i.e. related to the direction of the axis 3, the two half shells 19 are provided approximately in their center with a groove 20 circumferentially extending concentrically with the axis 3. On the upright tube 1 a projection in the shape of an outwardly protruding bead 21, circumferentially extending concentrically with the axis 3, is formed, which engages with the grooves 20, if the two half shells 19 are placed with their internal sides 22 against the external sides 23 of the upright tube 1, whereby they complement to form a sleeve, which forms the cone section 17. If the two half shells 19 firmly abut on the upright tube 1, they cannot be displaced in the direction of the axis 3 relative to the upright tube 1.

The two half shells 19 forming the cone section 17 taper—as already touched above—towards the lower end 10 of the upright tube 1; consequently, they have an external conical surface 24, which rests in a corresponding conical hub of a pedestal or the like.

As on the upright tube 1 there are formed several projections each in the shape of a circumferentially extending bead 21, the half shells 19 can be fixed in pairs on the upright tube 1 at different distances from the lower end 10 of the upright tube 1. The distance "a" of two adjacent beads 21 in the direction of the axis 3 in principle is arbitrary; it must only be larger than the distance "b" from the center of the groove 20 to the rim 25 of the cone section 17 located further apart, so that the two half shells 19 will engage with a bead 21 engaging with their grooves 20, however, will not collide with the adjacent bead or beads 21. Depending on the number of the beads 21 and their distance a from each other more or less large graduations in the height adjustment of the upright tube 1 relative to a pedestal are possible. From FIG. 1 also the conical angle "c" of the external conical surface 24 relative to the axis 3 can be seen.

The embodiment according to FIGS. 3 and 4 differs from that according to FIGS. 1 and 2 by the cone section 17 not consisting of two half shells, but of a sleeve 26, which is opened only on one side by a slot 27 extending parallel to the axis 3. The sleeve 26 comprises in the vicinity of its two front-sided rims 28, 29 groove-like, i.e. annularly extending recesses 30, 31, the center distance d of which recesses 30, 31 in the direction of the axis 3 corresponds to the center distance a' of two adjacent beads 21 on the upright tube 1'.

Whereas with the embodiment according to FIGS. 1 and 2 the cone section 17 is non-displaceable axially to the upright tube 1 with half shells 19 firmly abutting on the external side 23, because the side walls 32, 33 of the grooves 20 prevent displacement, with the embodiment according to FIGS. 3 and 4 this displacement is prevented by side wall 32' and 33' each being formed in a recess 30 or 31, respectively.

The embodiment according to FIG. 5 in turn comprises two half shells 19", which in the vicinity of their rims 28, 29 are provided with two groove-like recesses 30, 31. The two half shells 19" are further provided with a groove 20 between recesses 30, 31. In the same manner as in the embodiment according to FIGS. 3 and 4 the center distance a" of adjacent beads 21 is identical over the length of the upright tube 1". However, it is smaller than in the embodiment according to FIGS. 3 and 4, namely only half as large. It corresponds to the center distance d" from the middle groove 20 to the recess 30 or the recess 31, respectively. This means that with this embodiment a finer graduated height adjustment of the cone section 17 relative to the upright tube 1" is possible.

Whereas the half shells 19, 19" may consist of a relatively rigid material, the slotted sleeve 26 must consist of a material, which is elastic such that it can be expanded thus far to be pushed over the beads 21. Thus the half shells 19 can be made of zinc diecasting, aluminium diecasting, a very rigid plastic material or the like, whereas the slotted sleeve 26 should be made of a sufficiently elastic, but very firm plastic material, which may be POM (acetal resin) or PP (polyproylene), which if necessary may also be glass fiber reinforced.

Figure 6:
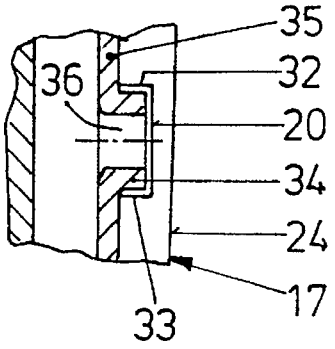
FIG. 6 shows a cut through a detailed illustration of a projection and FIG. 7 shows a chair with a chair column.

The projections, which have been formed by the beads 21 with the embodiments according to FIGS. 1 to 6, can also be formed by annular deformations 34—so-called "eyelets"—which are shown in FIG. 6. These deformations 34 are formed such that the wall 35 of the upright tube 1 or 1' or 1", respectively, while forming an opening 36 is pressed out outwardly, by means of which an annular, i.e. annular cylindrical deformation 34 is formed, which forms a projection. Several, preferably six, deformations 34 of this type are formed on a circle, which is concentrical about the axis 3, on the upright tube 1, 1', 1", which deformations 34 engage in flush manner with the groove 20 or the recesses 30, 31, respectively. With all shown embodiments the dimensions of the grooves 20 and of the recesses 30, 31 on the one hand and the beads 21 or the deformations 34, respectively, on the other hand should be such that the cone sections 17 in the direction of the axis 3 are arranged on the upright tube 1, 1', 1" at least substantially without play.

Figure 7:
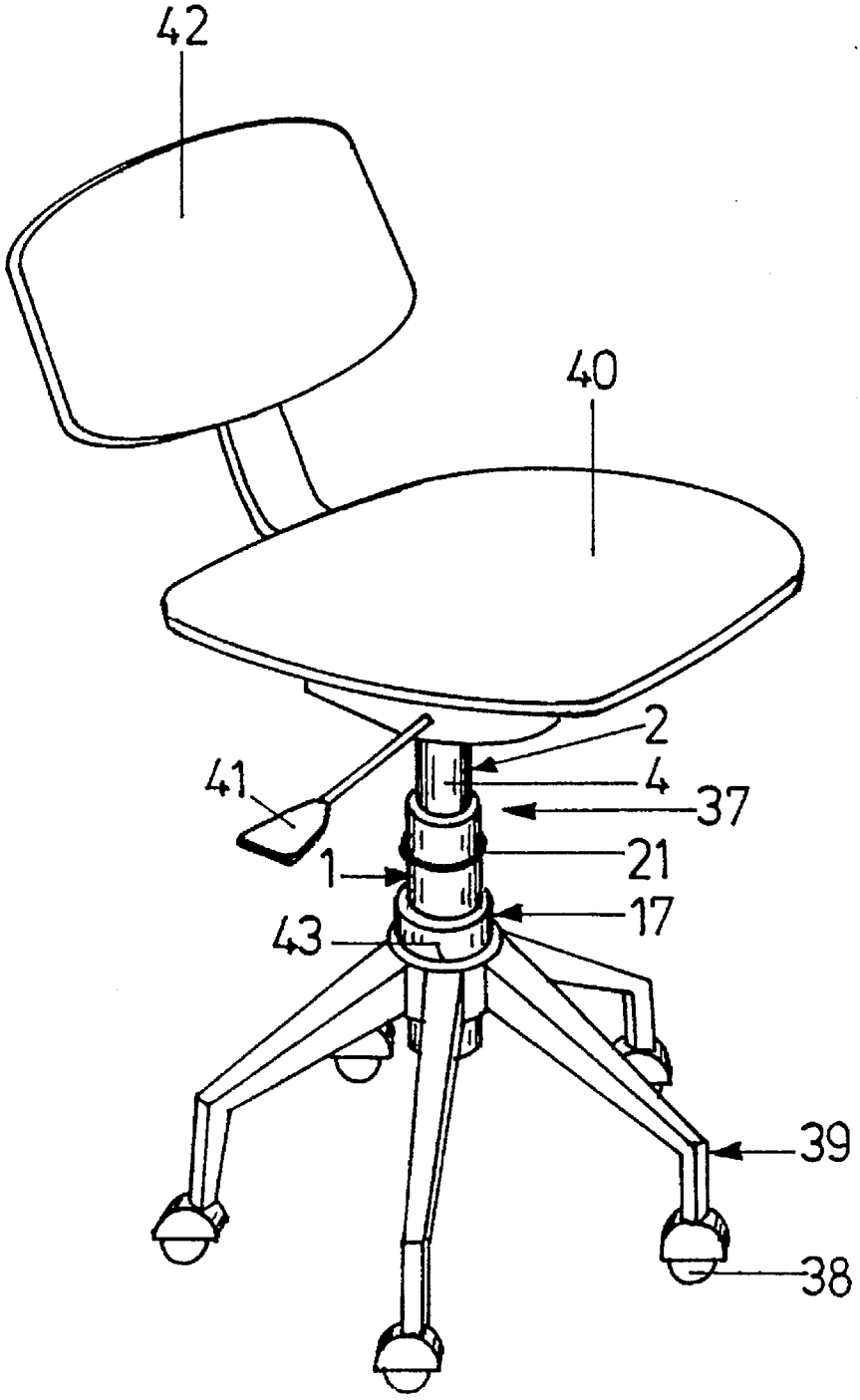

FIG. 7 shows the application of the described chair column 37 in a working chair. The latter comprises a pedestal 39 supported on the bottom via casters 38, on which pedestal 39 the chair column 37 is arranged protruding upwardly. The upper end of the housing 4, from which the actuating pin 16 protrudes, is secured to the lower side of a seat 40, a pivotable actuating lever 41 being provided for actuating the actuating pin 16. The chair comprises furthermore in usual manner a backrest 42. When actuating the actuating pin 16 of a valve located in the gas spring 2 by means of the actuating lever 41, the gas spring 2 can be adjusted in its length in usual manner, by means of which the seat 40 with the backrest 42 is adjusted in height.

The basic height of the seat 40 is given by the fact that the chair column 37 in the described manner is connected with the pedestal 39 in different height position. To this end the pedestal 39 comprises in its center in usual manner a conical hub 43 serving as an accommodation for the respective cone section 17, from which conical hub 43 relatively strongly curved foot struts 44 extend downward to the casters 38, so that the conical hub 43 has a distance to the bottom, which permits the described basic adjustments of the upright tube 1, 1', 1" to the pedestal 39.

Obviously, the longitudinally adjustable column can also be used for tables or the like.

What is claimed is:

1. A longitudinally adjustable column (37) for chairs, tables comprising:

a stand pipe (1, 1', 1",) with a central longitudinal axis (3), with an external side (23) and with at least two projections (21, 34) which are—related to the central longitudinal axis (3)—arranged at a distance from each other and extend outward from said external side (23), one of a pneumatic or hydropneumatic length-adjusting element (2) arranged concentrically with the central longitudinal axis (3) within the standpipe (1, 1', 1'), with an end of the length-adjusting element (21) engaged to a lower end of the stand pipe and a sleeve-like cone section (17) with an external conical surface (24) and with an internal side (22) removably engaged on the external side (23) of the stand pipe (1, 1', 1") and with at least one recess (20, 30, 31) engageable with one of said at least two projections (21, 34).

2. A longitudinally adjustable column according to claim 1, wherein the cone section (17) is formed as a sleeve (26) divided by a slot (27).

3. A longitudinally adjustable column according to claim 2, wherein the sleeve (26) is made of a hard elastic material.

4. A longitudinally adjustable column according to claim 1, wherein the cone section (17) consists of two half shells (19, 19").

5. A longitudinally adjustable column according to claim 1, wherein said at least one recess is formed as a groove (20).

6. A longitudinally adjustable column according to claim 1, wherein the at least one recess is formed as a groove (20) which opens towards an—related to the axis (3)—end-sided rim (28, 29) of the cone section (17).

7. A longitudinally adjustable column according to claim 1, wherein the cone section (17)—related to the central longitudinal axis (3)—is arranged on the standpipe (1, 1', 1") substantially without play.

8. A longitudinally adjustable column according to claim 1, wherein at least one of said at least two projections is formed by an annular deformation (34).

9. A longitudinally adjustable column according to claim 1, wherein a projection of said at least two projections is formed by an annular deformation (34).

* * * * *